US009788629B2

(12) United States Patent
Blum

(10) Patent No.: US 9,788,629 B2
(45) Date of Patent: Oct. 17, 2017

(54) COLLAPSIBLE CHAMBER WITH SUSPENSION DEVICES TO DRY HAIRPIECE ARTICLES

(71) Applicant: Sheryl Blum, Rosemead, CA (US)

(72) Inventor: Sheryl Blum, Rosemead, CA (US)

( * ) Notice: Subject to any disclaimer, the term of this patent is extended or adjusted under 35 U.S.C. 154(b) by 461 days.

(21) Appl. No.: 14/331,944

(22) Filed: Jul. 15, 2014

(65) Prior Publication Data

US 2014/0325863 A1 Nov. 6, 2014

Related U.S. Application Data

(63) Continuation-in-part of application No. 13/674,305, filed on Nov. 12, 2012, now Pat. No. 8,813,385.

(51) Int. Cl.
*A45D 20/14* (2006.01)
*A45D 20/00* (2006.01)

(52) U.S. Cl.
CPC ..... *A45D 20/00* (2013.01)

(58) Field of Classification Search
CPC .... A45D 20/14; A45D 20/44; A45D 2200/05; F26B 25/066; F26B 25/08; F26B 25/10; F26B 25/12
USPC ..... 392/380, 383; 34/383, 96, 97, 101, 201, 34/202
See application file for complete search history.

(56) References Cited

U.S. PATENT DOCUMENTS 5,528,840 A * 6/1996 Pajak ..... A47L 23/20 34/202
8,555,519 B2 * 10/2013 McFarland ..... F26B 9/003 190/124
2008/0168675 A1 * 7/2008 Garman ..... F26B 9/003 34/195
2010/0252520 A1 * 10/2010 Hsu ..... A47B 47/024 211/186

* cited by examiner

*Primary Examiner* — Kenneth Rinehart
*Assistant Examiner* — John McCormack
(74) *Attorney, Agent, or Firm* — Alexis J Saenz

(57) ABSTRACT

A hairpiece article drying apparatus is provided. The apparatus may be a chamber configured for placement on a support surface. The chamber may be configured to hold a hairpiece article for drying. The chamber may include an airflow duct between interior and exterior panels. A suspension element may be coupled to an interior surface of the chamber interior to hold the hairpiece article suspended above the support surface in the chamber interior within the airflow.

10 Claims, 10 Drawing Sheets

COLLAPSIBLE CHAMBER WITH SUSPENSION DEVICES TO DRY HAIRPIECE ARTICLES

BACKGROUND OF THE INVENTION

The present invention generally relates to dryers, and more particularly, to a collapsible countertop chamber with suspension devices to dry hairpiece articles.

Wigs and other hairpiece articles may be worn for any of a variety of reasons, including fashion, religion, any form of hair loss, or simply for aesthetics allowing one to wear wigs in a style that might not be possible with one's own hair. Wigs need to be washed, set, and dried periodically. Typically, wigs and other hairpiece articles have a netting substrate to hold the hair strands. The netting may change shape when wet and subsequently dried so one mounts the wig on a block. The block holds the wig's shape while dried. One approach to drying for example, a wig, involves manually blow drying the strands while the wig is mounted on a block. However, the process may be time intensive requiring the person to actively stay with the wig. Uniformity in drying may suffer since the person may not distribute the drying air appropriately around the wig.

The drying of other hairpiece articles may present similar challenges. Hairpiece articles, for example, toupees, hair extensions, ponytail extensions, etc. may require actively staying with the hairpiece article which is time consuming and may cause uneven drying.

As can be seen, there is a need for an apparatus for hairpiece articles that is compact, may be used in the home or in a professional salon, and does not require manual manipulation of the dryer to uniformly bake dry the hairpieces.

SUMMARY OF THE INVENTION

In one aspect of the present invention, a hairpiece article drying apparatus comprises a heat resistant material having a plurality of walls attached to each other at common edges to form a chamber for placement on a support surface, the chamber including interior panels spaced from exterior panels defining an airflow duct between the interior and exterior panels, the interior panels configured to define a chamber interior configured to hold a hair hairpiece article for drying; a collapsible wire frame within sleeves around the common edges of four of the sides of the chamber, the wire frame and the chamber configured to form: a first, erect configuration with the wire frame, the first erect configuration including at least two of the interior panels parallel to each other and disposed to be spaced from the hairpiece article as the hairpiece article is positioned between the at least two interior panels, and a second, collapsed configuration; an air intake coupled to one of the exterior panels, disposed to transmit air into the duct, wherein the interior panels include air holes disposed to circulate airflow into the chamber interior and all around the hairpiece article; and a suspension element coupled to an interior surface of the chamber interior, the suspension element configured to hold the hairpiece article suspended above the support surface in the chamber interior within the airflow.

In another aspect of the present invention, a hairpiece article drying system comprises a heat resistant material having a plurality of walls attached to each other at common edges to form a chamber, the chamber including interior panels spaced from exterior panels defining an airflow duct between the interior and exterior panels, the interior panels configured to define a chamber interior configured to hold a hairpiece article for drying; a collapsible wire frame coupled to the common edges of the chamber, the wire frame and the chamber movable between a first, erect configuration for placement on a support surface, the first erect configuration including at least two of the interior panels parallel to each other and a second, collapsed configuration; an air intake coupled to one of the exterior panels, disposed to transmit air into the duct, wherein the interior panels include air holes disposed to circulate airflow into the chamber interior and all around the hairpiece article; and a plurality of loops attached to opposing interior panels, wherein at least a first of the loops and a second of the loops are aligned to hold a removable rail in between the opposing interior panels These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention generally provides a collapsible countertop chamber using an external heat source to dry wigs.

Figure 1:
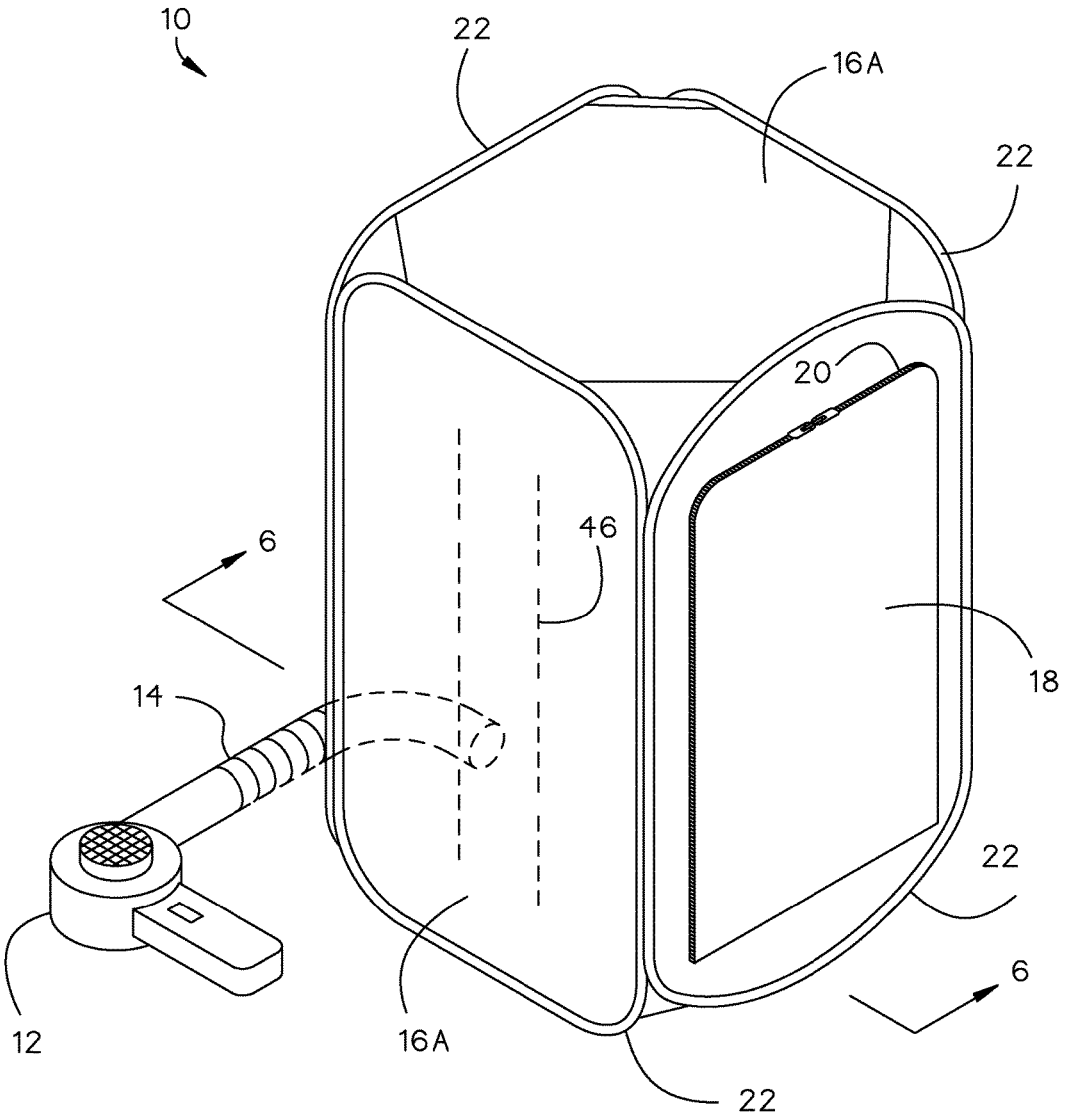
FIG. 1 is a front perspective view of an exemplary embodiment of a wig drying apparatus of the present invention having a single-wig capacity.
Figure 1A:
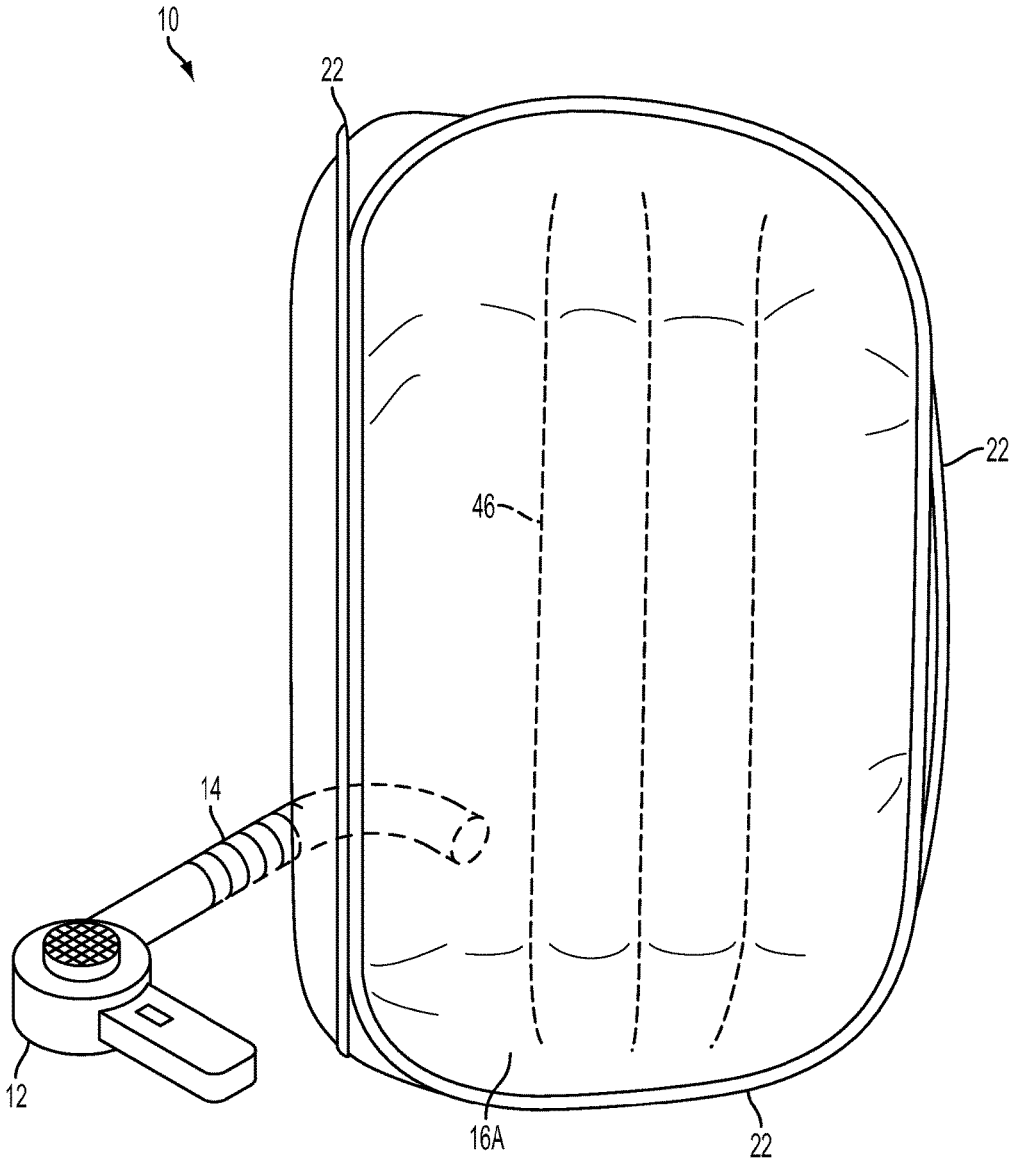
FIG. 1A is the wig drying apparatus shown with channel ducting expanded by forced air.

Referring to FIGS. 1-6, an apparatus for drying a single wig is shown according to an exemplary embodiment of the present invention. The apparatus may include a chamber 10 formed by a flexible wire frame 26 and a heat resistant fabric 16*a*. The fabric 16*a* may be cut with six sections which, when their edges are sewn or otherwise attached to each other at common edges, may form a six sided chamber 10 (including a bottom and a top). Three of the lateral sides and the top side may be double fabric forming exterior and interior panels 16*a*, 16*b* sewn together with vertical stitching to create air ducts with holes 24 in the interior panels to evenly distribute the airflow. A space 16*c* is formed between the two panels 16*a*, 16*b*. Seams 46 may adjoin a panel 16*a* to a panel 16*b* to provide channeled ducting between adjacent sets air holes 24. It may be appreciated that the channel ducting defined by the seams 46 may prevent the panels 16*a* and 16*b* from overexpansion by forced air being channeled through the space 16*c* (for example, as shown in FIG. 1A). Sleeves 22 may be formed along common edges of the four sections that form the front, back and sides of the chamber 10. The wire frame 26 may be made from four loops of steel wire having a cross-sectional dimension such as, for example, about 1 mm by about 3 mm. The four wire loops may fit within the four sleeves 22. The wire frame 26, and therefore the chamber 10, may have a first, box-like configuration and a second, collapsed configuration.

A front side of the chamber 10 may include a door 18 that may be made from a clear plastic to view the inside of the chamber 10. The door 18 may be permanently attached to the panel 16*a* on one edge (such as the lower edge) as illustrated in FIG. 1. A zipper 20 around the other three edges may allow the door 18 to be opened and closed. It will be appreciated that other means may be used to allow the door to be opened and closed.

Figure 2:
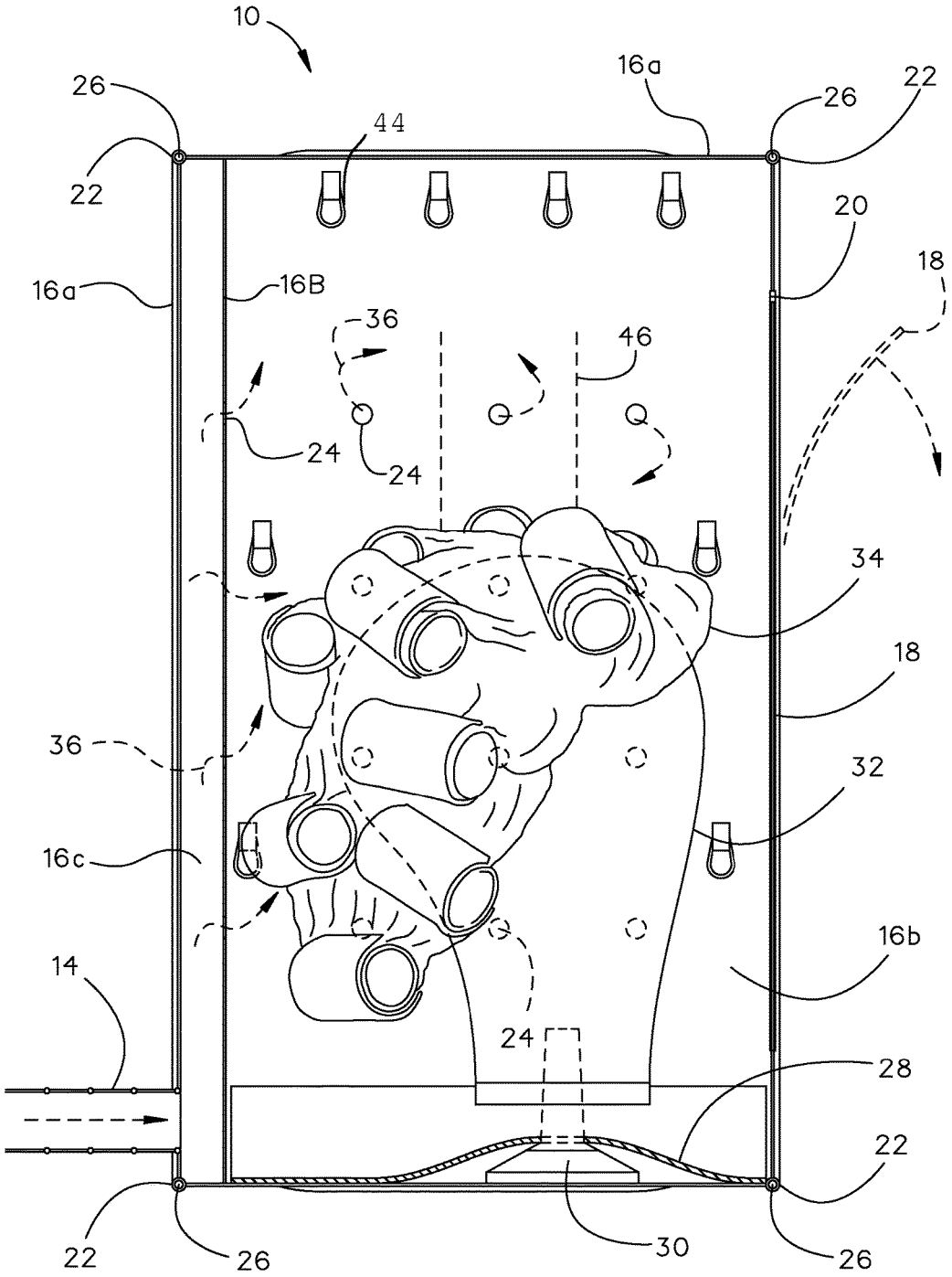
FIG. 2 is section view of the wig drying apparatus taken along line 2-2 in FIG. 1.
Figure 3:
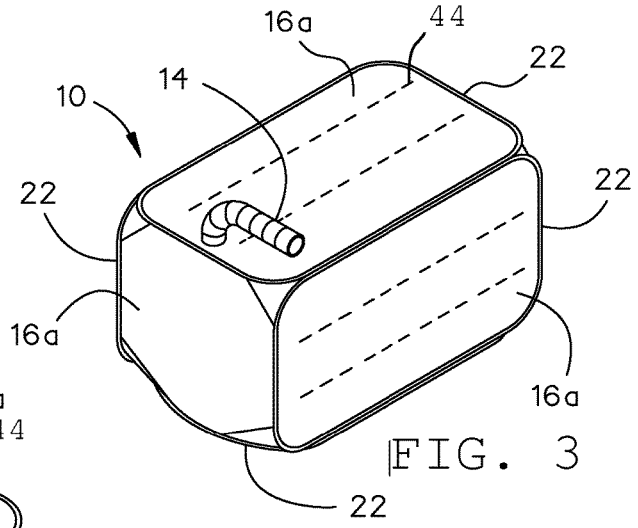
FIG. 3 is a rear perspective view of the wig drying of apparatus FIG. 1.

One end of a flexible air intake tube 14 may be secured to an opening in the exterior panel 16*a* of another side of the chamber 10 (such as the back side) to allow hot air to flow into the space between the exterior and interior panels 16*a*, 16*b*, through the air holes 24, and into interior of the chamber 10, as illustrated in FIG. 2. The other end of the intake tube 14 is designed to removably receive and retain the air outlet end of a hand-held blow dryer 12 or other external heat source. Within the chamber 10 may be a heat-resistant floor mat 28 and a wig block stand 30. In an exemplary embodiment, loops 44 (or other suspension elements) may be positioned on various interior surfaces to hold items which will be described in further detail below.

To use, the chamber 10 may be placed on a counter top or other surface. The door 18 may be opened and a wig block 32, on which a wig 34 to be dried has been placed, may be passed through the door and placed onto the wig block 30 stand within the chamber 10. The door 18 may then be closed. After a hair dryer 12 is attached to the air intake tube 14, the dryer may be turned on. Although the hair dryer 12 may have a variety of blower and heat settings, high blower and high heat settings may decrease the drying time of the wig 34. Hot air 36 may enter the chamber 10 through the air intake tube 14, flow through the space 16*c* between the exterior and interior panels 16*a*, 16*b*, and circulate uniformly throughout the chamber 10 via air holes 24 in the inner panel 16*b*. As illustrated in FIG. 2, the air holes 24 are vertical running center of the stitched air ducts of three sides of the panels 16*a*, 16*b* creating the drying chamber 10.

Figure 4:
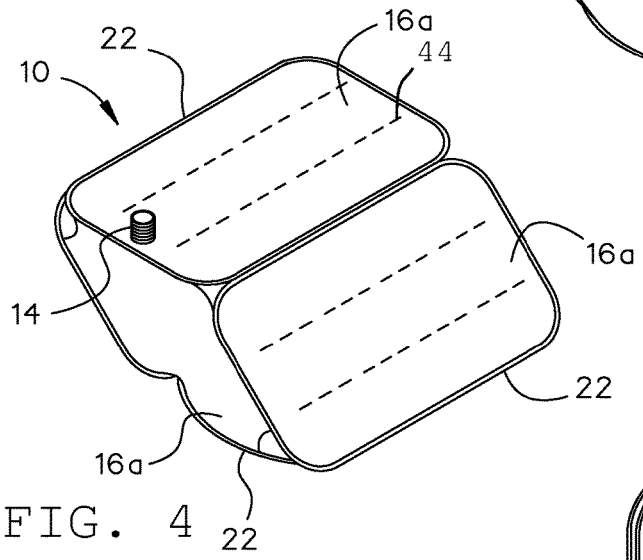
FIG. 4 is a rear perspective view of the wig drying of apparatus FIG. 1 in a semi-collapsed position.
Figure 5:
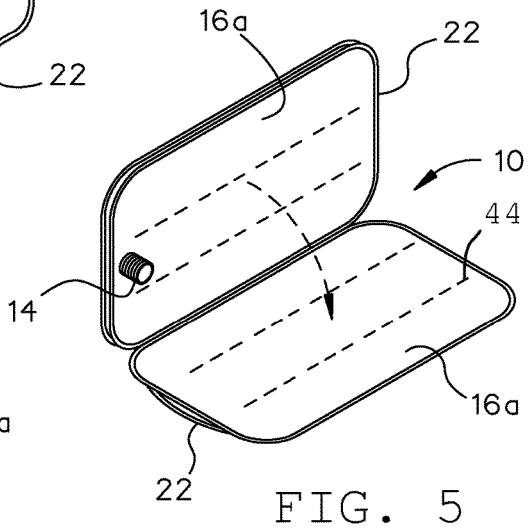
FIG. 5 is a rear perspective view of the wig drying of apparatus FIG. 1 in the collapsed and pre-folded position.
Figure 6:
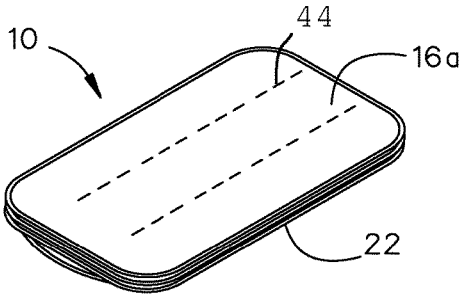
FIG. 6 is a rear perspective view of the wig drying of apparatus FIG. 1 in the fully collapsed and final folded position.
Figure 7:
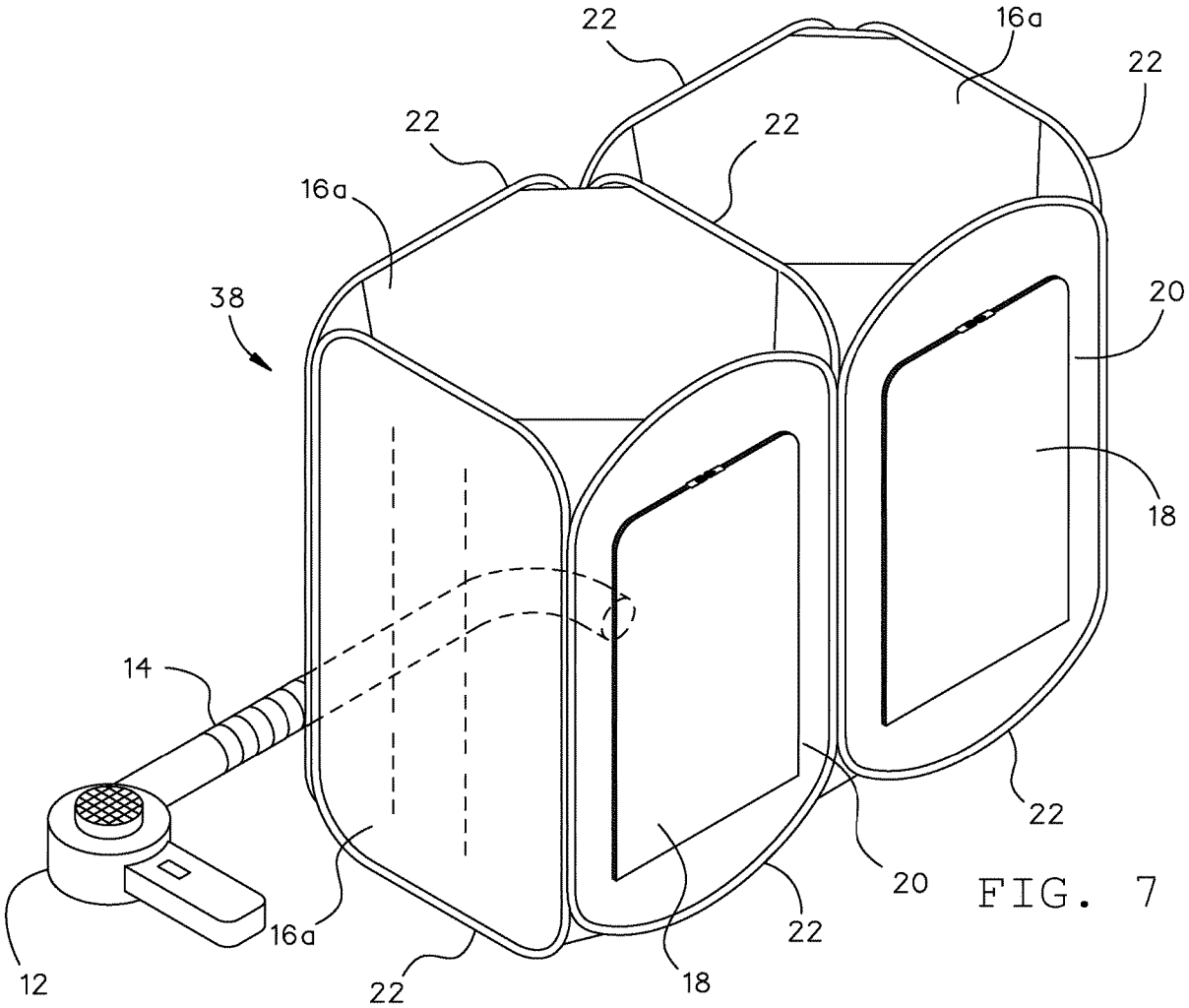
FIG. 7 is a front perspective view of another embodiment of a wig drying apparatus—the present invention having a multiple wig capacity.
Figure 8:
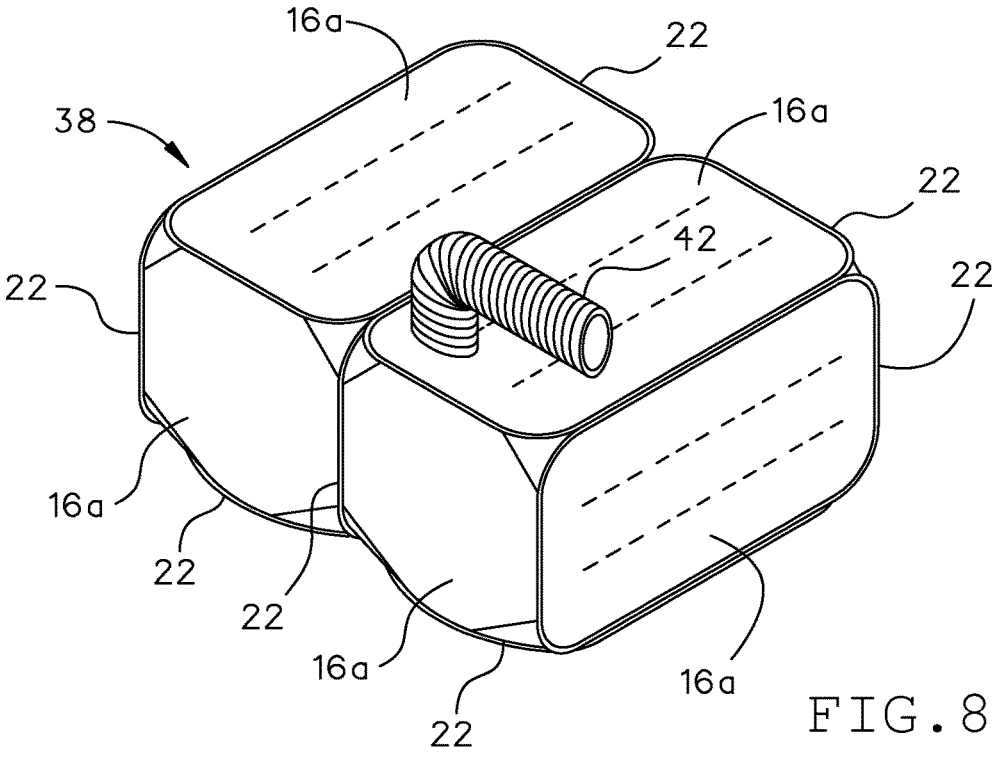
FIG. 8 is a rear perspective view of the wig drying of apparatus FIG. 7.
Figure 9:
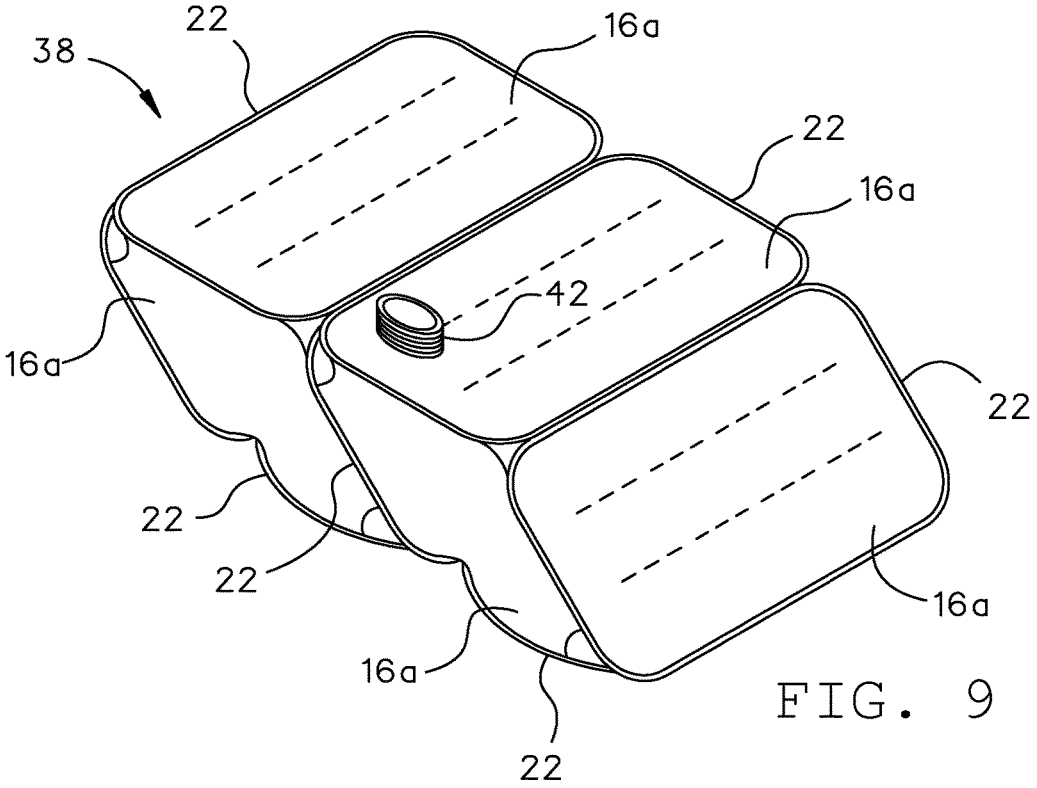
FIG. 9 is a rear perspective view of the wig drying of apparatus FIG. 7 in a semi-collapsed position.
Figure 10:
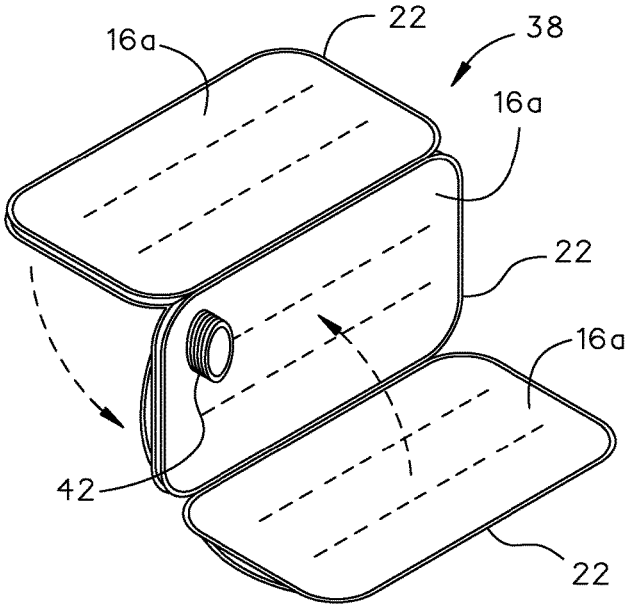
FIG. 10 is a rear perspective view of the wig drying of apparatus FIG. 7 in the collapsed and pre-folded position.
Figure 11:
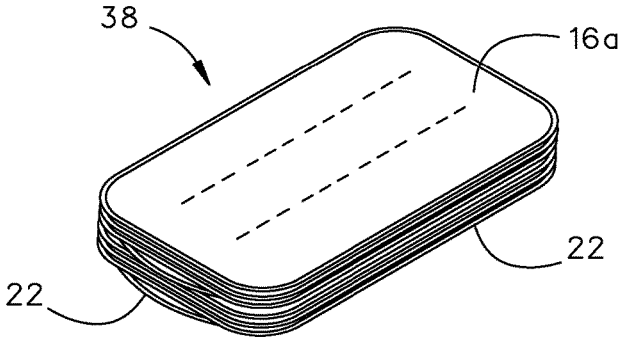
FIG. 11 is a rear perspective view of the wig drying of apparatus FIG. 7 in the fully collapsed and final folded position.

After the wig 34 has been dried, the hair dryer 12 may be turned off and the wig 34, the wig block 32, the wig block stand 30, and the floor mat 28 may be removed from the chamber 10 through the door 18. The hair dryer 12 may be detached from the chamber 10. The chamber 10 and wire frame 26 may then be collapsed for storage, as illustrated in FIGS. 3-6. The air intake tube 14 may be collapsed and one adjoining side of the chamber 10 may be pushed into the center against the two opposite adjoining sides (FIG. 4). The panels of the remaining two sides (such as the top and bottom sections) may be folded onto itself (FIGS. 5 and 6). The apparatus may then be stored in a relatively small space.

Referring to FIGS. 7-11, a chamber 38 that is large enough to dry multiple wigs is shown according to another embodiment of the present invention. The large chamber 38 may have two doors 18 and be heated with a larger drying unit 40 through a larger flexible air intake tube 42. The large chamber 38 may be used to dry wigs in the same way as the smaller chamber 10 and may be collapsed by pressing the opposing corners into the center (FIG. 10), then pressing the three panels together which lay against each other with the fabric of the other two sides sandwiched in between, leaving the chamber 10 and wire frame 26 substantially flat (FIG. 11) for storage.

In contrast to large, cumbersome, and expensive wig driers (that may range in size from four feet by four feet by two feet to six feet by six feet by two feet, the drying chambers 10, 38 of the present invention may be compact, portable, easily stored, and relatively inexpensive.

Referring now to FIGS. 12-15, a hairpiece article drying chamber 100 (referred to generally as the chamber 100) is shown according to an exemplary embodiment of the present invention. The chamber 100 may include the same source of airflow and mechanisms for air circulation and may be collapsible via the framing described with respect to the chamber 10. In an exemplary embodiment, the chamber 100 may be configured to hold hairpiece articles, (not shown) for example, wigs, toupees, hair extensions, ponytail extensions, etc., suspended from an interior surface of the chamber and within a drying airflow. Various types of suspension elements (for example, loops 44 shown throughout FIGS. 12-15; rails 48 shown in FIG. 14, and platforms 50 shown in FIG. 15) may be configured to elevate the hairpiece articles from the supporting surface on which the chamber is placed. The suspension elements may in some embodiments, hold the hairpiece articles away from the interior panels 16*b*.

Figure 12:
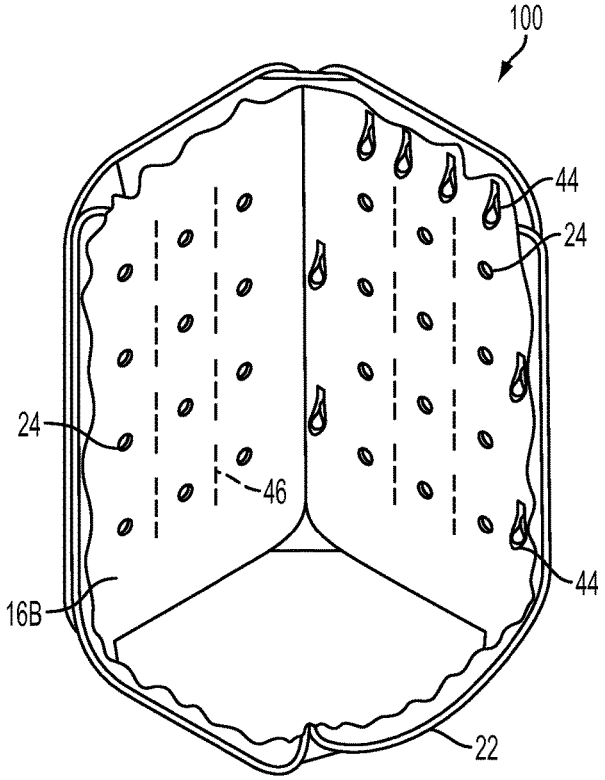
FIG. 12 is a cutaway, right side perspective interior view of a hairpiece article drying chamber in accordance with yet another exemplary embodiment of the present invention.
Figure 13:
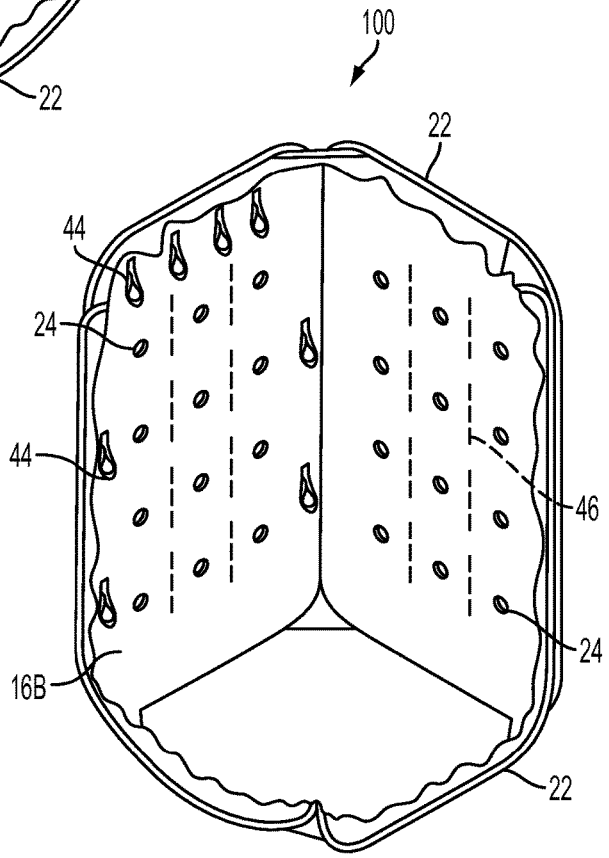
FIG. 13 is a cutaway, left side perspective interior view of the hairpiece article drying chamber of FIG. 12.

Referring now to FIGS. 12 and 13, the chamber 100 is shown with loops 44 attached to one of the interior panels 16*b*. The loops 44, which may be cotton twill, may be configured to hold, for example, rails 48 (FIG. 14) or platforms 50 (FIG. 15). An exemplary loop 44 may be about a ½ inch to 1 inch in diameter before widened to accommodate a platform or rail.

Figure 14:
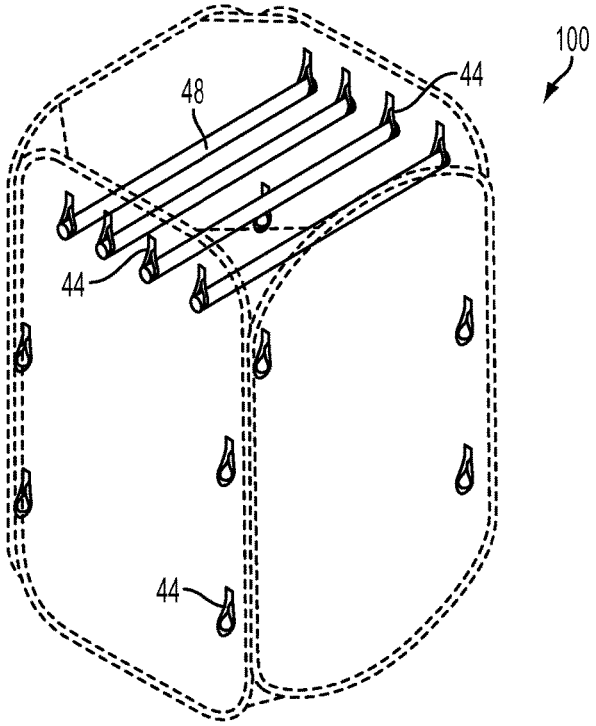
FIG. 14 is a perspective interior view of the hairpiece article drying chamber of FIG. 12 including rails.
Figure 15:
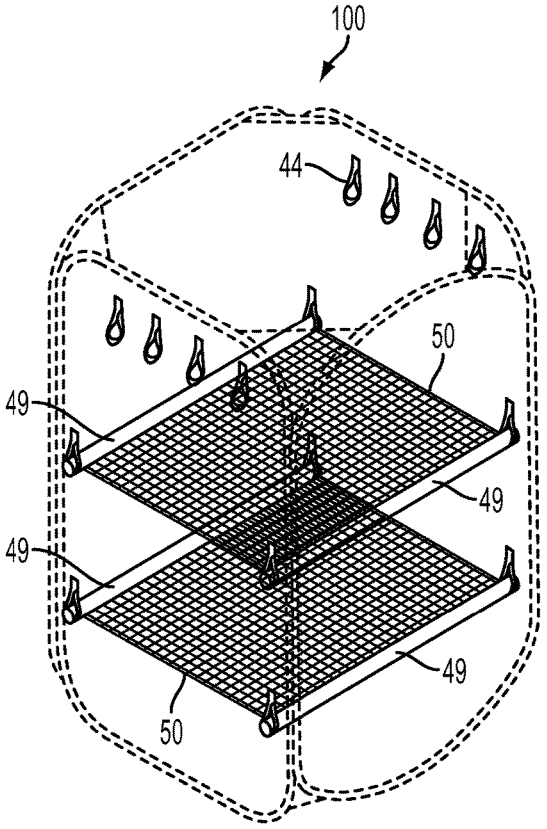
FIG. 15 is a perspective interior view of the hairpiece article drying chamber of FIG. 12 including platforms.

Referring now to FIG. 14, in some embodiments, the chamber 100 may incorporate rails 48 to suspend hairpiece articles within the chamber interior. For example, some hairpiece articles may be clipped onto a rail 48. Ends of the rails 48 may be inserted into loops 44 on opposing interior panels 16*b*. Thus, the height of a rail 48 above the supporting surface may be adjusted based on the length of the hairpiece article being suspended. Typically, a hairpiece article attached to a rail 48 may be hung towards the center of the chamber 100 and thus, airflow from the interior panels 16*b* may be distributed around the hairpiece article.

Referring now to FIG. 15, the chamber 100 may include a platform 50 to hold hairpiece articles suspended in the chamber interior. The platform 50 may be configured to hold hairpiece articles horizontally above the support surface. The platform 50 may be meshed or perforated. The platform 50 may include sleeves 49 on opposing edges. The sleeves 49 are configured to fit around the rails 48 (FIG. 14). The rails 48 may be inserted into loops 44 so that the platform 50 may be suspended substantially planar to and above the support surface. In an exemplary use, a hairpiece article may be placed onto the platform 50 to dry a hairpiece article in styles that may not be possible if the hairpiece article were hanging or blocked. The airflow in the chamber 100 may circulate all around and through the platform 50 exposing the entirety of the hairpiece article to evenly distributed drying.

Similar to the chamber 10, a user may place a hairpiece article into the chamber 100, turn on the airflow to a desired intensity and leave the hairpiece article unattended while the chamber 100 distributes air all around the hairpiece article. Suspending the hairpiece article may have the added benefit that the underside of the hairpiece article (which may be typically protected from airflow when mounted onto a block) may receive exposure to airflow, thus an even distribution of drying may be achieved. In addition, a hairpiece article may not be subjected to direct heat to any one area of the article thus preventing over drying and potential burning of the article.

Figure 16:
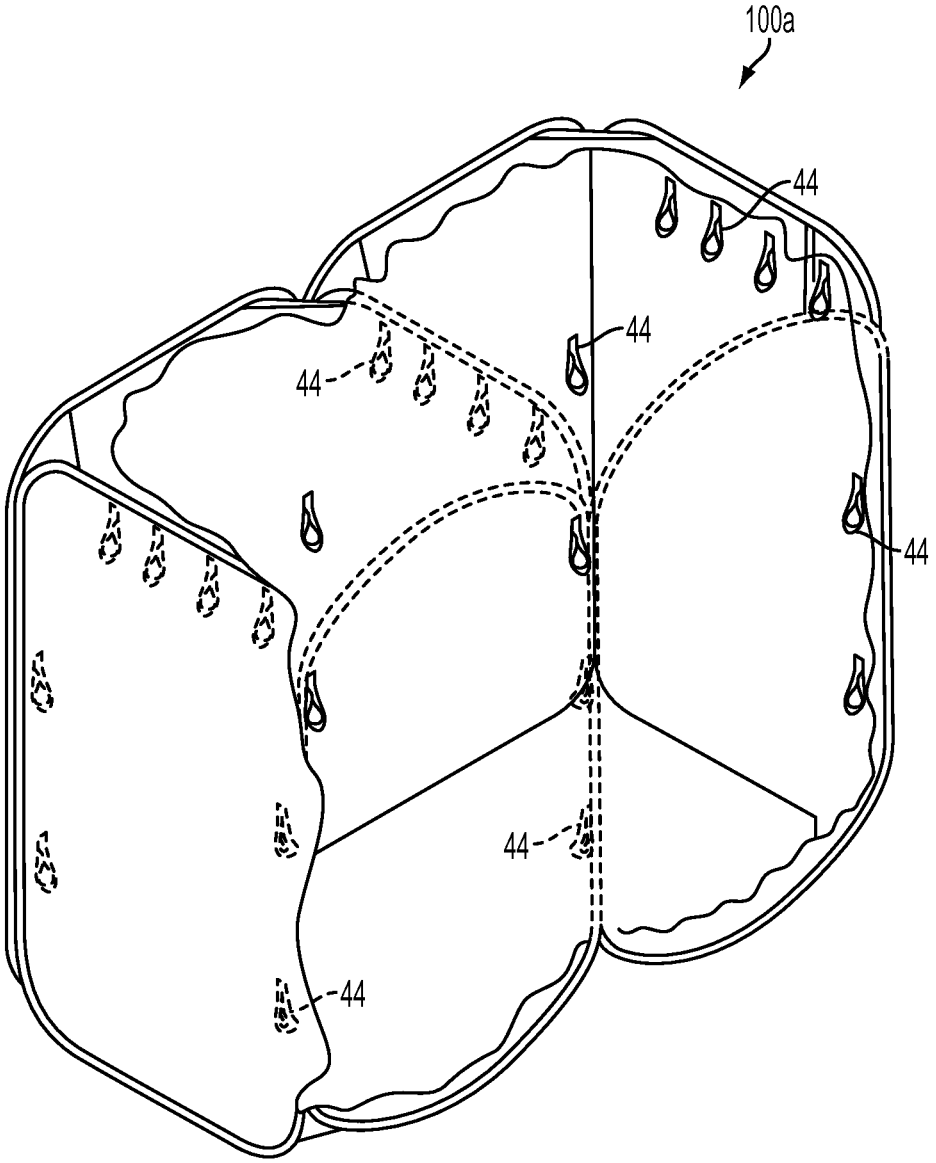
FIG. 16 is a perspective top view of a hairpiece article drying chamber in accordance with yet another exemplary embodiment of the present invention.

Referring now to FIG. 16, a chamber 100*a* is shown according to another exemplary embodiment of the present invention. The chamber 100*a* is similar to the chamber 100 except that the chamber 100*a* may incorporate a multi-chamber configuration so that the same air source may blow dry various hairpiece articles simultaneously. For sake of illustration, only loops 44 are shown however it will be understood that other suspension elements, for example, the rails 48 and platforms 50 of FIGS. 14 and 15 may be included in the chamber 100*a*.

It should be understood, of course, that the foregoing relates to exemplary embodiments of the invention and that modifications may be made without departing from the spirit and scope of the invention as set forth in the following claims.

What is claimed is:

1. A hairpiece article drying system, comprising:

a heat resistant material having a plurality of walls attached to each other at common edges to form a chamber, the chamber including interior panels spaced from exterior panels defining an airflow duct between the interior and exterior panels, the interior panels configured to define a chamber interior configured to hold a hairpiece article for drying;

a collapsible wire frame coupled to the common edges of the chamber, the wire frame and the chamber movable between a first, erect configuration for placement on a support surface, the first erect configuration including at least two of the interior panels parallel to each other and a second, collapsed configuration;

an air intake coupled to one of the exterior panels, disposed to transmit air into the duct, wherein the interior panels include air holes disposed to circulate airflow from the duct into the chamber interior and all around the hairpiece article;

a plurality of loops attached to opposing interior panels, wherein at least a first of the loops and a second of the loops are aligned to hold a pair of removable rails in between the opposing interior panels; and a mesh or perforated platform extending between the pair of removable rails.

2. The system of claim 1, wherein the platform is configured to permit airflow to pass through an underside of the platform and contact an underside of the hairpiece article.

3. A hairpiece article drying apparatus, comprising:

a heat resistant material having a plurality of walls attached to each other at common edges to form a six-sided chamber for placement on a support surface, at least three of the sides including double fabric forming interior and exterior panels, the interior panels spaced from the exterior panels, defining an airflow duct between the interior and exterior panels, the interior panels configured to define a chamber interior configured to hold a hairpiece article for drying;

a collapsible wire frame within sleeves around the common edges of four of the sides of the chamber, the wire frame and the chamber configured to form:

a first, erect configuration with the wire frame, the first erect configuration including at least two of the interior panels parallel to each other and disposed to be spaced from the hairpiece article as the hairpiece article is positioned between the at least two interior panels, and a second, collapsed configuration with the wire frame;

an air intake coupled to one of the exterior panels, disposed to transmit air into the airflow duct, wherein the interior panels include air holes disposed to circulate airflow from the airflow duct into the chamber interior and all around the hairpiece article; and suspension devices attached to opposing interior panels of the chamber interior at points intermediate any two of the common edges, the suspension devices configured to hold the hairpiece article suspended above the support surface in the chamber interior within the airflow.

4. The apparatus of claim 3, wherein the suspension devices are loops attached to an interior panel.

5. The apparatus of claim 4, wherein the loops are configured to hold the end of a rail or platform.

6. The apparatus of claim 4, wherein the loops are affixed to one of the interior panels.

7. The apparatus of claim 3, wherein the suspension devices are a rail suspended between two opposing interior panels by loops.

8. The apparatus of claim 3, wherein the suspension devices include a platform suspended by rails supported by loops between two opposing interior panels.

9. The apparatus of claim 8, wherein the platform is perforated and configured to permit airflow to contact an underside of the hairpiece article.

10. The apparatus of claim 3, wherein the interior and exterior panels are joined with vertical stitching forming air ducts.

* * * * *